US005407190A

United States Patent [19]

Hehn

[11] Patent Number: 5,407,190

[45] Date of Patent: Apr. 18, 1995

[54] METHOD OF AND APPARATUS FOR POSITIONING PHOTOSENSITIVE SHEETS

[75] Inventor: Wilfried Hehn, München, Germany

[73] Assignee: Agfa-Gevaert Aktiengesellschaft, Leverkusen, Germany

[21] Appl. No.: 300,702

[22] Filed: Sep. 2, 1994

Related U.S. Application Data

[63] Continuation of Ser. No. 72,513, Jun. 4, 1993, abandoned.

[30] Foreign Application Priority Data

Jul. 4, 1992 [DE] Germany ..... 42 21 994.9

[51] Int. Cl.[6] ..... B65H 5/00

[52] U.S. Cl. ..... 271/225; 271/267; 271/184; 198/456; 354/319; 354/339

[58] Field of Search ..... 271/184, 225, 228, 248, 271/250, 252, 266, 267, 268, 272, 226; 198/456; 354/319-322, 335, 339

[56] References Cited

U.S. PATENT DOCUMENTS 3,910,402 10/1975 Dean ..... 271/184 X
4,191,369 3/1980 Matsuda et al. ..... 271/225 X
5,080,345 1/1992 Daniels ..... 271/248 X

FOREIGN PATENT DOCUMENTS 149058 11/1981 Japan ..... 271/225
230441 9/1988 Japan ..... 271/272
198952 8/1990 Japan ..... 271/228

*Primary Examiner*—Charyl L. Gastineau
*Assistant Examiner*—Boris Milef
*Attorney, Agent, or Firm*—Darby & Darby

[57] ABSTRACT

Successive or selected sheets of a series of exposed sheets of photosensitive material which are to enter a developing machine are shifted sideways through identical distances or through randomly selected distances so that each next-following sheet partially registers with one or more preceding sheets. The series can consist of a single row or of plural rows of exposed sheets. Such lateral staggering of the sheets ensures that the sheets contact each portion of each advancing roll in the developing machine so that the rolls cannot gather layers of impurities which could affect the quality of next-following sheets. The sheets of the series have identical formats.

10 Claims, 1 Drawing Sheet

METHOD OF AND APPARATUS FOR POSITIONING PHOTOSENSITIVE SHEETS

This is a continuation of application Ser. No. 08/072,513, filed Jun. 4, 1994, now abandoned.

BACKGROUND OF THE INVENTION

The invention relates to improvements in methods of and in apparatus for manipulating sheets, and more particularly to improvements in methods of and in apparatus for manipulating photosensitive sheets, e.g., in photographic processing laboratories.

The processing of exposed photographic films and the making of prints on photographic paper involves the transport of such sheet- or web-like materials at different speeds. This creates problems, particularly in connection with the advancement of paper sheets in the developing machine of a photographic processing laboratory. For example, the speed of paper sheets through the developing, fixing and rinsing baths of a developing machine is less than the speed of sheets in the copying machine. Thus, if the speed of sheets in the developing machine were to be raised to match the speed of such sheets in the copying machine, the length of the path for the sheets in the developing machine would have to be increased accordingly (in order to ensure that each sheet is contacted by the developing and other solutions for a required internal of time). This is not always possible because any lengthening of the path for exposed sheets of photographic paper through the developing machine would entail a corresponding increase in the bulk and space requirements of such machine. On the other hand, the space is at a premium in a so-called minilab, e.g., a processing laboratory which is set up to develop an exposed photographic film, to copy selected frames of the exposed and developed film onto photosensitive paper, to develop the thus exposed photographic paper, to sever the developed paper into discrete prints and to collate the prints with the corresponding film frames so that the order can be picked up by a customer within 60 minutes (or even less) from the time of delivery.

Commonly owned patent application Ser. No. 07/942,431 of Erich Nagel (filed Sep. 9, 1992 for "Apparatus for converting a file of successive sheets into plural rows of sheets") discloses an apparatus which can be used in a photographic processing laboratory to permit the development of a larger number of sheets of exposed photosensitive paper without increasing the bulk and space requirements of the developing machine for exposed photosensitive paper. This is accomplished in that the apparatus is designed to convert a single file or row of exposed but undeveloped sheets into plural rows, and the plural rows are caused to advance through the developing machine. The apparatus of Nagel employs a carriage which can be moved sideways to stagger the oncoming sheets and to thus convert a single row of oncoming sheets into plural rows of sheets which are ready to be introduced into the developing machine. The disclosure of the application of Nagel is incorporated herein by reference.

The baths of a developing machine contain small particles of contaminants, e.g., fragments of sheet advancing rolls. The floating particles descend onto and tend to adhere to the peripheral surfaces of rolls in the developing machine while the machine is idle. As a rule, the thus gathered accumulations of particles are removed from the peripheral surfaces of the rolls when the developing machine is restarted because the oncoming sheets rub against and remove such accumulations of impurities. In other words, the developing machine is automatically cleaned when in use so that the particles of foreign matter cannot gather on the exposed sheets in numbers and sizes such that they would affect the quality of the exposed and developed images. However, if an apparatus of the type disclosed in the patent application Ser. No. 07/942,431 of Nagel is used extensively for the advancement of plural rows of sheets, those portions of the rolls in the developing machine which are located between neighboring rows are likely to gather entire layers of impurities. Such layers are harmless as long as the apparatus continues to process several rows of relatively narrow sheets. However, if the same apparatus is thereupon used for the advancement of relatively wide sheets which cannot form two or more rows because the width of the path for the sheets is barely sufficient to accommodate a single row of relatively wide sheets, the accumulations of solid impurities on the rolls of the developing machine are removed by the foremost (wide) sheets of a single row of sheets. The thus removed layers of impurities are readily visible on the finished prints in the form of elongated dark strips or streaks which render the prints useless or, at the very least, detract considerably from their appearance.

Attempts to avoid the deposition of dark strips on the foremost sheets of a fresh row of sheets of photographic paper or other photosensitive material have met with limited success. For example, it was proposed to install automatic cleaning units which employ brushes and are set in operation before the developing machine is restarted or before the machine is restarted to advance relatively wide sheets subsequent to long-lasting transport of plural rows of relatively narrow sheets. It was also proposed to advance a series of so-called cleaning sheets through the developing machine prior to advancement of exposed photosensitive sheets so that the specially designed cleaning sheets remove layers of impurities from the rolls in the developing machine before the latter is put to renewed use but for the development of a single row of wide sheets following a long-lasting use for the development of plural rows of narrower sheets. Such additional equipment is expensive and contributes to the bulk of the developing machine. Moreover, its cost does not justify the installation in a developing machine which is used primarily for the development of relatively wide sheets forming a single row, or primarily for the development of narrower sheets forming several rows.

OBJECTS OF THE INVENTION

An object of the invention is to provide a method which renders it possible to keep the rolls or other transporting elements of a developing machine clean regardless of whether the machine is used for the development of wide or narrow sheets.

Another object of the invention is to provide a method which renders it possible to avoid the development of unsightly streaks or stripes on the foremost sheets of a series of wide sheets if such sheets are developed subsequent to long-lasting development of narrower sheets which are delivered to the machine in the form of plural rows.

A further object of the invention is to provide a novel and improved method of positioning sheets on their way toward and in a developing machine.

An additional object of the invention is to provide a method which renders it possible to avoid the development of the aforementioned streaks or stripes by relying on the cleaning or contamination-preventing action of the processed material, i.e., of exposed sheets of photosensitive paper or the like.

Still another object of the invention is to provide a novel and improved apparatus for the practice of the above outlined method.

A further object of the invention is to provide a photographic processing laboratory which embodies the novel apparatus and wherein wider sheets of photosensitive material are not likely to develop unsightly stripes or like defects when their development follows the development of a long series of narrower sheets.

Another object of the invention is to provide the apparatus with novel and improved means for regulating the distribution of sheets of exposed photosensitive material on their way toward and into the developing machine.

An additional object of the invention is to provide the apparatus with novel and improved means for shifting from one mode of distributing sheets on their way to a developing machine to one or more different modes.

Still another object of the invention is to provide a minilab which embodies an apparatus of the above outlined character.

SUMMARY OF THE INVENTION

One feature of the present invention resides in the provision of a method of manipulating the sheets of a series of photosensitive sheets in a sheet treating apparatus. The improved method comprises the steps of advancing the sheets of the series in a predetermined direction along a predetermined path; and staggering or shifting at least some of the sheets transversely of the path so that each successive sheet partially registers (as seen in the predetermined direction) with at least one preceding sheet of the series.

The sheets of the series preferably have at least substantially identical sizes or formats.

The shifting step can include randomly selecting the extent of shifting or staggering of the at least some sheets transversely of the path. Alternatively, the shifting step can include shifting the at least some sheets through substantially identical distances transversely of the path with reference to the preceding sheets of the series, preferably with reference to immediately preceding sheets of the series.

The shifting step can include shifting each and every sheet of the series of sheets.

The series of sheets can include two or more rows of successive sheets, and the shifting step then preferably comprises shifting at least some sheets in each row of sheets.

Another feature of the present invention resides in the provision of an apparatus for manipulating sheets of a series of photosensitive sheets in a treating apparatus or machine. The improved manipulating apparatus comprises means for advancing the sheets of the series in a predetermined direction along a predetermined path, and means for staggering or shifting at least some of the sheets transversely of the path so that each successive sheet of the series partially registers with at least one preceding sheet of the series.

The shifting means can comprise a carriage for the sheets. Such shifting means can further comprise an adjustable mover (e.g., an electric motor) for the carriage and means for adjusting the mover so as to move the carriage and the sheet or sheets thereon transversely of the path. The adjusting means can include a random signal generator. The means for moving the carriage can include a stepping motor which moves the carriage through increments of identical length in order to shift successive sheets of a longer or shorter series of sheets transversely of the predetermined path.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
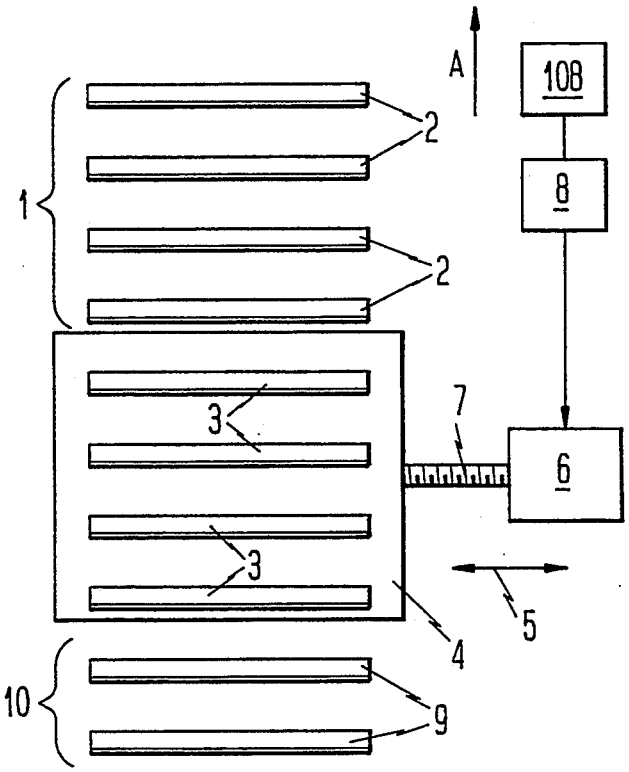
FIG. 1 is a fragmentary schematic plan view of a sheet manipulating apparatus which embodies one form of the present invention.
Figure 3:
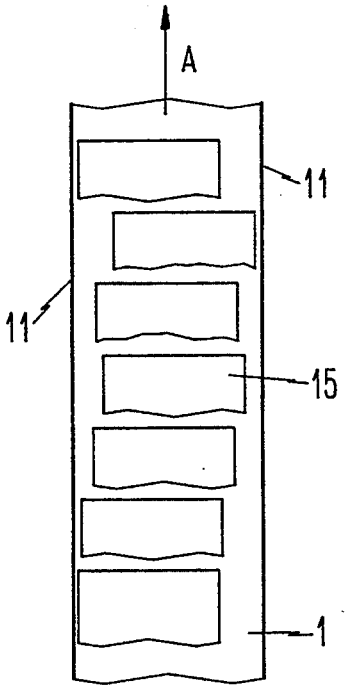
FIG. 3 is a similar plan view of a portion of an apparatus which transports a single file or row of identical sheets.
Figure 4:
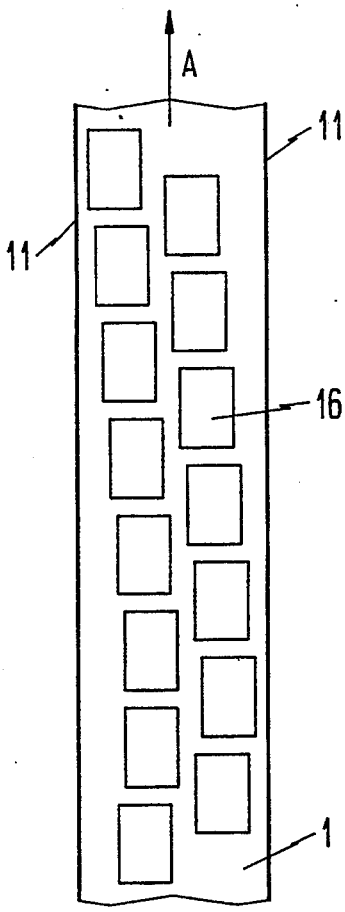
FIG. 4 is a similar plan view of a portion of an apparatus which transports several rows of sheets having identical sizes.

Referring first to FIG. 1, there is shown a portion of an apparatus which is designed to manipulate photosensitive sheets in a sheet treating apparatus or machine, for example, in a so-called minilab wherein a series of sheets must be transported from a copying machine 10 to a developing machine 1. The apparatus comprises a set of suitably driven rolls 9, 3 and 2 which serve to advance a series of sheets (e.g., a single file or row of sheets 15 as shown in FIG. 3 or a plurality of files or rows of sheets 16 as shown in FIG. 4) in a predetermined direction (arrow A) along an elongated path defined in apart by a slide or carriage 4. This carriage constitutes an element of means for shifting some or all of the sheets in one of the directions indicated by a double-headed arrow 5, namely transversely of (e.g., at right angles to) the direction of arrow A.

The rolls 2 serve to advance successive sheets of the series of sheets through the developing machine, e.g., a developing machine for exposed sheets of photographic paper. The rolls 9 serve or form part of means for transporting the sheets of the series of sheets through the copying machine 10 wherein successive frames or selected frames of an exposed and developed photographic roll film are imaged onto successive sheets while resting on a copying platform, not shown.

The rolls 3 serve to transport sheets between the rolls 9 and 2 and are mounted on and share the movements of the carriage 4 in the directions indicated by the double-headed arrow 5. Reference may be had to the application of Nagel. The shifting means further comprises a mover 6, e.g., an electric motor which can move the carriage 4 by rotating a feed screw 7. The means for adjusting or controlling the motor 6 can include a computer 8 which, when in use, can induce the motor to shift the carriage 4 transversely of the path of successive sheets through increments of randomly selected magnitude (see FIG. 3). Alternatively, the computer 8 can be programmed to operate the motor 6 (e.g., a standard stepping motor) in such a way that the carriage 4 is shifted through increments of identical magnitude so that the sheets can be staggered through identical distances (see FIG. 4). The computer 8 can embody or can be combined with a conventional random signal generator 108 which, when in use, causes the computer to operate the motor 6 in a manner to stagger the sheets in random fashion, for example, as shown in FIG. 3.

The selection of the nature of the series of sheets (i.e., in the form of a single row or in the form of plural rows) will depend upon the size or format of the sheets. The rolls 3 can be at a standstill while the carriage 4 is in motion in one of the directions indicated by the double-headed arrow 5, and the rolls 3 are thereupon set in motion to advance the sheet or sheets thereon into the range of the rolls 2 in the developing machine.

Figure 2:
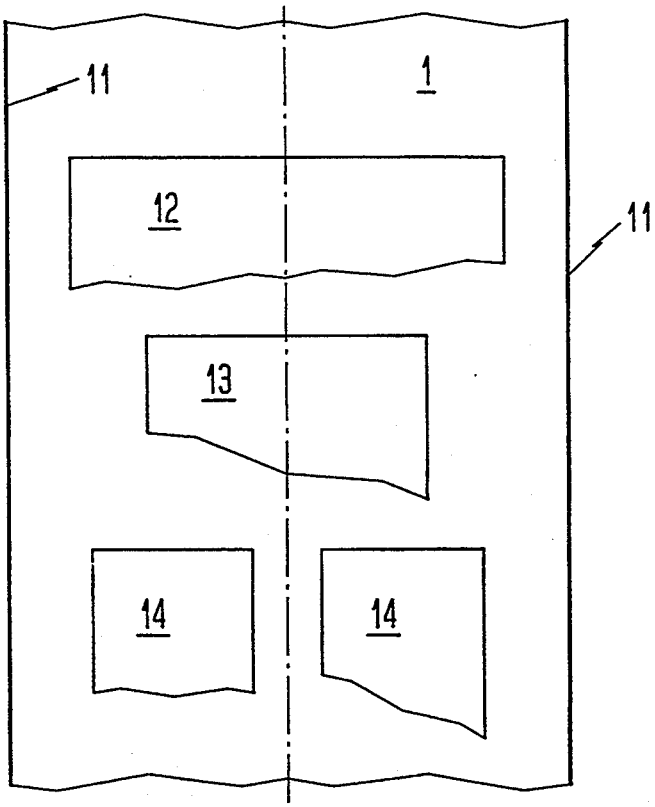
FIG. 2 is a simplified plan view of a portion of an apparatus which transports sheets having different sizes.

FIG. 2 illustrates a portion of the developing machine 1 with lateral boundaries or stops 11 (e.g., in the form of walls or the like). The distance between the boundaries 11 is preferably 260 mm. This provides ample room for paper sheets 12 having a width of 12 inches, for paper sheets 13 having a width of 5 inches, or for paper sheets 14 having a width of three inches. It will be seen that the distance between the boundaries 11 suffices to permit the advancement of a series of sheets which form two rows and each of which has a width of 3.5 inches. These are the presently preferred standard widths of paper sheets which are used in processing laboratories of the type known as minilabs and normally designed to complete the development of photographic films, the copying of selected exposed and developed film frames on photographic paper, and the development of exposed photographic paper (as well as the collating of prints with the respective film frames) within 60 minutes or even less.

The rolls 2 are most likely to gather layers of contaminants which could affect the quality of photographic prints. Therefore, the shifting means 4, 6, 7, 8, 108 of the improved apparatus is installed in the path of advancement of a series of sheets from the copying machine 10 to the developing machine 1. The cleaning of rolls 2 is effected by the sheets themselves, and it is important to ensure that each and every portion of each roll 2 be adequately cleaned in continuous fashion, i.e., whenever the developing machine 1 is in use. This is accomplished by staggering the sheets in a manner such that each following sheet is in partial register with at least one preceding sheet of the series so that each and every portion of each roll 2 is contacted by sheets in actual use of the developing machine. Thus, in lieu of advancing the sheets in the form of one or more rows in each of which the sheets are in accurate alignment or register with one another (as seen in the direction of arrow A), the sheets of the single row or the sheets of each row are staggered transversely of the direction indicated by the arrow A. This entails automatic cleaning of the rolls 2 and reduces the likelihood of the making of unsatisfactory prints caused by the gathering of layers of impurities on the peripheral surfaces of the rolls 2.

FIG. 3 shows a single row of identical sheets 15 (e.g., sheets having a width of 8 inches) which are randomly staggered transversely of their path between the boundaries 11. Each next-following sheet 15 is in partial register with one or more preceding sheets 15 so that the sheets cover practically the entire width of the path for such sheets. Such random staggering of the sheets 15 can be achieved by activating the random signal generator 108 so that the computer 8 causes the motor 6 to randomly shift the carriage 4 through increments within a range which suffices to ensure that the randomly staggered sheets 15 jointly form a row having a width nearly matching the distance between the boundaries 11. The computer 8 is programmed to ensure that the carriage 4 can shift the sheet or sheets thereon between two extreme positions in one of which a sheet is immediately or closely adjacent the left-hand boundary 11 and in the other of which a sheet is immediately or closely adjacent the right-hand boundary 11. The random signal generator 108 selects the number of steps which the (stepping) motor 6 can perform to randomly shift or stagger successive sheets 15 of the series of sheets transversely of the path of such sheets, either to one of the two extreme positions or to any one of a preferably large number of intermediate positions (this is clearly shown in FIG. 3).

FIG. 4 shows a series of sheets 16 having a width of 3 inches or 3.5 inches and forming two rows. Each next-following sheet 16 of each of the two rows is shifted relative to the preceding sheet of the same row through a preselected distance (e.g., corresponding to a single step of the motor 6). Thus, the random signal generator 108 of FIG. 1 can be turned off and the computer 8 controls the operation of the motor 6 in such a way that the motor causes the carriage 4 to advance through a preselected distance in a direction to the left or to the right and to thus stagger successive sheets 16 of each row in a manner as shown in FIG. 4. The spacing of sheets 16 in each row (or of sheets 15 in the single row shown in FIG. 3) may but need not be the same.

It is further clear that the motor 6 can be adjusted in any one of a number of additional ways without departing from the spirit of the invention. For example, the random signal generator 108 can be turned off when the carriage 4 is to stagger sheets 15 which form a single row so that such sheets are staggered in a manner as shown for the sheets 16 in the left-hand row or the right-hand row of FIG. 4. Analogously, the sheets 16 in each of the plural rows of such sheets can be staggered in random fashion. All that counts is to ensure that the sheets which are being advanced through the developing machine 1 adequately clean each and every portion of each roll 2 or, at the very least, each and every portion of that part of the peripheral surface of each roll 2 which comes into consideration for the advancement of one or more rows of sheets through the developing machine. This reduces the likelihood of the development of dark stripes on the finished prints as a result of the deposition of contaminants on selected portions of peripheral surfaces of the rolls 2.

An important advantage of the improved apparatus (and of the method which can be practiced with such apparatus) is it simplicity. Thus, by the simple expedient of shifting the carriage 4 through increments of identical magnitude or randomly selected magnitude transversely of the direction of advancement of the series of sheets (not for the purpose of forming plural rows out of a single row, as taught by Nagel), one ensures a thorough cleaning of each and every roll 2 all the way between its ends or a thorough cleaning of that portion of the peripheral surface of each roll 2 which comes into consideration for engagement with narrow, medium wide or wide sheets. More specifically, the method of the present invention can be resorted to in order to prevent contamination of the rolls 2, i.e., the distribution of sheets between the boundaries 11 is such that the sheets prevent deposition of appreciable quantities of contaminants on these rolls. This holds true irrespective of whether the apparatus is used for the advancement of sheets having different widths or is used extensively or exclusively for the advancement of sheets having a single width. As a rule, or in many instances, the apparatus will be used in machines which are employed for the making of prints having different sizes, i.e., a width of 3 inches, 3.5 inches, 5 inches or 8 inches.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of manipulating the sheets of at least one row of photosensitive sheets in a sheet treating apparatus wherein at least some of the sheets are of substantially the same size, comprising the steps of advancing the sheets of the at least one row in a predetermined direction along a predetermined path; and shifting at least some of the sheets transversely of the path so that each successive sheet partially registers with at least one preceding sheet such that substantially each and every portion of the path in the sheet treating apparatus is contacted by the sheets and that the same side edges of a series of sheets having the same size are positioned on spaced apart lines in said predetermined direction along said predetermined path.

2. The method of claim 1, wherein all the sheets of said at least one row have at least substantially identical sizes.

3. The method of claim 1, wherein said shifting step includes randomly selecting the extent of shifting of said at least some sheets transversely of said predetermined path.

4. The method of claim 1, wherein said shifting step includes shifting said at least some sheets through substantially identical distances transversely of said predetermined path with reference to the immediately preceding sheets of the at least one row.

5. The method of claim 4, wherein said shifting step includes shifting each sheet of said at least one row of sheets.

6. The method of claim 1, wherein a plurality of rows of successive sheets are provided and said shifting step comprises shifting at least some sheets in each of said plurality of rows.

7. Apparatus for manipulating the sheets of at least one row of photosensitive sheets in a sheet treating apparatus wherein at least some of the sheets are of substantially the same size, comprising means for advancing the sheets of the at least one row in a predetermined direction along a predetermined path; and means for shifting at least some of the sheets transversely of the said path so that each successive sheet partially registers with at least one preceding sheet such that substantially each and every portion of the path in the sheet treating apparatus is contacted by the sheets and that the same side edges of a series of sheets having the same size are positioned on spaced apart lines in said predetermined direction along said predetermined path.

8. The manipulating apparatus of claim 7, wherein said shifting means comprises a carriage for the sheets.

9. The manipulating apparatus of claim 8, wherein said shifting means further comprises an adjustable mover for said carriage and means for adjusting said mover so as to move the carriage and at least one sheet thereon transversely of said path.

10. The manipulating apparatus of claim 9, wherein said adjusting means comprises a random signal generator.

* * * * *